US005309606A

United States Patent [19]

Kawamura

[11] Patent Number: 5,309,606

[45] Date of Patent: May 10, 1994

[54] TONGUE ASSEMBLY FOR USE IN A SEAT BELT DEVICE

[75] Inventor: Yoshihisa Kawamura, Shiga, Japan

[73] Assignee: Takata Corporation, Tokyo, Japan

[21] Appl. No.: 483,486

[22] Filed: Nov. 30, 1992

[30] Foreign Application Priority Data

Dec. 6, 1991 [JP] Japan ..... 3-322968

[51] Int. Cl.[5] ..... A44B 11/06

[52] U.S. Cl. ..... 24/196; 24/171

[58] Field of Search ..... 24/196, 194, 197, 685 B, 24/171; 280/801, 802, 808

[56] References Cited

U.S. PATENT DOCUMENTS

| | | | |
|---|---|---|---|
| 3,163,905 | 1/1965 | Gaylord | 24/196 |
| 4,480,854 | 11/1984 | Doty . | |
| 4,588,207 | 5/1986 | Doty . | |
| 4,903,377 | 2/1984 | Doty . | |
| 4,979,764 | 12/1990 | Drinane et al. | 24/196 X |
| 5,050,274 | 9/1991 | Staniszewski et al. | 24/196 X |

FOREIGN PATENT DOCUMENTS

| | | | |
|---|---|---|---|
| 1166529 | 3/1964 | Fed. Rep. of Germany | 24/196 |
| 1577535 | 4/1970 | Fed. Rep. of Germany | 24/196 |
| 2506297 | 8/1975 | Fed. Rep. of Germany | 24/196 |
| 1449242 | 7/1966 | France | 24/196 |
| 2-35012 | 9/1990 | Japan . | |

*Primary Examiner*—Laurie K. Cranmer
*Attorney, Agent, or Firm*—Kanesaka & Takeuchi

[57] ABSTRACT

A tongue assembly for use in a seat belt device is formed of a tongue main body engaging a buckle and a slider slidably disposed over the main body. A first slit is situated in a middle portion of the main body to extend in a direction perpendicular to an inserting direction of the main body relative to the buckle. A first wall portion is fixed to the main body to project upwardly from an upper surface of the main body along the first slit at a side of a rear portion. A second wall portion is formed in an upper side of the slider and has a surface opposing to the first wall portion. A second slit is formed at a lower side of the slider so that a rear edge of the second slit at a side of a rear portion of the main body is situated close to an insertion portion of the main body with respect to the surface of the second wall. A third slit is further formed in the rear portion of the main body. A seat belt extends between the first and second wall portions, through the first and second slits, under the lower side of the slider and through the third slit so that when a tension is applied from the side of the third slit, the slider is pulled toward the rear portion of the main body to urge the second wall portion of the slider to the first wall portion to thereby strongly hold the seat belt between the first and second wall portions.

7 Claims, 8 Drawing Sheets

TONGUE ASSEMBLY FOR USE IN A SEAT BELT DEVICE

FIELD OF THE INVENTION

The present invention relates to a tongue assembly to which a seat belt is engaged and, more in particular, it relates to a tongue assembly suitable to a case in which a child seat is secured to a vehicle seat by means of a belt.

DESCRIPTION OF THE RELATED ART

As is well-known, a seat belt device is disposed to a vehicle and it has a function of holding and protecting an occupant on a seat upon collision of the vehicle.

As one of such seat belt devices, there has been known a three-point seat belt device as shown in FIG. 11, in which a tongue 12 is put over a belt 10, the top end of which is secured to a vehicle body while the rear end of which is wound around a seat belt retractor (not illustrated), and the tongue 12 is inserted into a buckle 14 secured to the vehicle body.

A child seat (seat set for infant) 18 placed on a seat 16 is sometimes secured to the seat 16 as shown in FIG. 11 by using the belt 10 of the three-point seat belt device (for example as disclosed in Japanese Utility Model Publication Hei 2-35012). In the drawing, 10A denotes a portion of the belt 10 situated on the side of the top end from the tongue 12 (lap belt), and the child seat 18 is constrained by the portion 10A. 10B denotes a portion situated on the side of the retractor from the tongue 12 (shoulder belt).

In such a child seat fixing structure, it is necessary that the lap belt 10A is always stretched under a sufficient tension to firmly secure and hold the child seat 18 to the seat 16 even when the shoulder belt 10B of the tongue 12 on the side of the retractor slackens.

In Japanese Utility Model Publication Hei 2-35012, the belts 10A and 10B are overlaid at the portion of the tongue 12, so that the tension of the belt 10A on the side of the top end is maintained by friction between both of them.

As a seat belt device capable of maintaining the tension of the lap belt 10A, U.S. Pat. Nos. 4,480,854, 4,588,207 and 4,903,377 disclose a structure as shown in FIGS. 9 and 10, in which a slider 22 is fit over a tongue main body 20, the slider 22 is resiliently biased backward to the tongue by the tension applied to the belt 10 so as to put the belt 10 between a wall 24 disposed to the tongue main body 20 and a rear edge 26 of the slider 22.

The above-mentioned constitution in the prior art involves a problem that the belt slips, failing to maintain a sufficiently high tension to the top end side 10A of the belt.

OBJECT AND SUMMARY OF THE INVENTION

An object of the present invention is to provide a tongue assembly capable of firmly holding a lap belt.

In the first aspect of the present invention, a tongue assembly for use in a seat belt device comprises a plate-like tongue main body having a front edge defined as a portion to be inserted into a buckle and a first slit disposed therebehind for the insertion of a belt and extended laterally crossing the longitudinal direction, a slider having a flat frame shape surrounding a portion of the tongue main body situated behind the insertion portion and fitted over that tongue main body retractably in the longitudinal direction, a first wall portion raised from one of plate surfaces of the tongue main body at the rear edge of the first slit of the tongue main body, a second wall portion disposed to oppose to the first wall portion at a rear edge of portion of the slider that opposes to the one of the plate surfaces of the tongue main body and capable of seizing a belt with respect to the first wall portion, a second slit for insertion of the belt extended in the lateral direction at a position overlapping the first slit in a portion of the slider that opposes to the other of the plate surfaces of the tongue main body, in which the rear edge of the second slit situates ahead of the rear edge of the first slit even when the first wall portion and the second wall portion are overlapped while seizing the belt therebetween, a third slit extended laterally behind the first slit of the tongue main body, in which the third slit situates behind the rear edge of the slider even when the first wall retracts to a retracting limit.

A tongue assembly for use in a seat belt device in the second aspect of the present invention is as defined in the first aspect, in which a recess is disposed to the tongue main body for communicating the third slit and the rear edge of the tongue main body.

In the tongue assembly for use in the seat belt device according to the present invention, the shoulder belt is inserted from one of the plate surfaces into a portion between the first wall of the tongue main body and the second wall of the slider rear edge and, further, inserted into the first slit of the tongue main body. Further, it is passed through the second slit of the slider and turned to the rearward of the tongue assembly, and pulled out from the third slit to the side of one of the plate surfaces to form a lap belt.

In the constitution as described above, when a tension is applied to the belt, the slider is pushed to the backward of the tongue assembly by the tension and the belt is put between the first and the second wall portions.

In the present invention, the lap belt is turned to the backward from the second slit to the third slit. Accordingly, since the force exerted on the slider by the tension applied to the lap belt substantially directs just behind, the slider is resiliently biased backward extremely strongly. Accordingly, it is held between the first and the second wall portions strongly. Therefore, even when the shoulder belt slackens, an extremely high tension remains in the lap belt. That is, even if the shoulder belt slackens, the lap belt is kept to continuously hold the child seat strongly.

PREFERRED EMBODIMENTS

Figure 1:
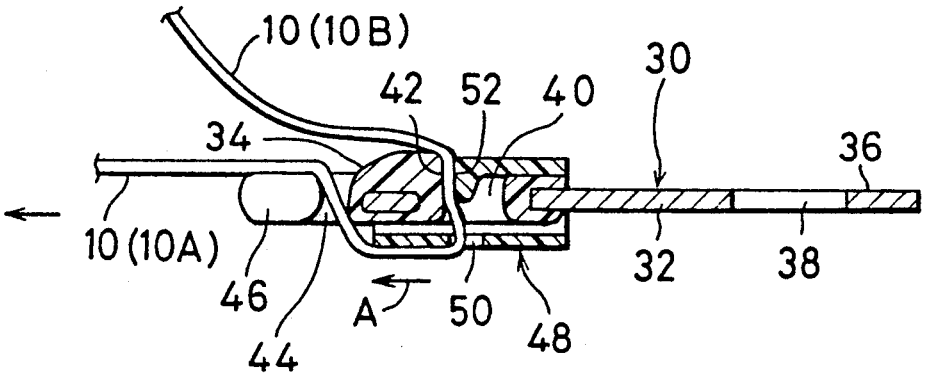
FIG. 1 is a vertical cross sectional view in a state in which a belt is passed through a tongue assembly in an embodiment according to the present invention.
Figure 2:
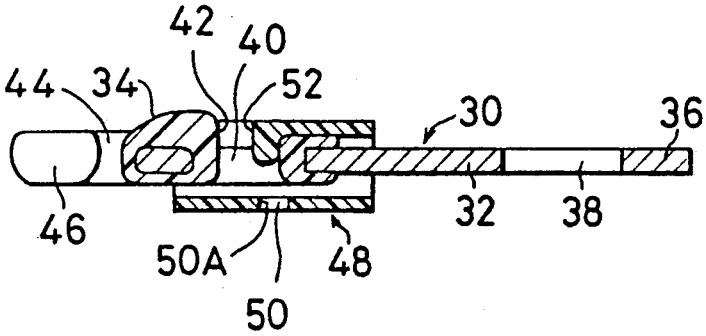
FIG. 2 is a vertical cross sectional view of the tongue assembly in a state in which the belt is removed.

Description will now be made to preferred embodiments of the present invention with reference to FIGS. 1 through 7.

A plate-like tongue main body 30 comprises a metal plate 32 and a synthetic resin portion 34 secured to the metal plate 32. The metal plate 32 and the synthetic resin portion 34 are integrated by insert molding.

The front end of the metal plate 32 constitutes an insertion portion 36 into a buckle not illustrated and the insertion portion 36 has an opening 38 perforated therein for engagement with an engaging member of the buckle.

A first slit 40 is perforated at the rear end of the tongue main body 30 and a first wall 42 is formed from the rear edge of the slit 40 so as to protrude at one side (upper surface in FIG. 1) of the tongue main body.

Further behind the first slit 40, a third slit 44 is perforated to extend in a lateral direction crossing the longitudinal direction of the tongue main body 30. A recess 46 is formed so as to communicate the longitudinal middle portion of the third slit 44 with the rear edge of the tongue main body 30, so that a belt 10 can be inserted through the recess 46 into the third slit 44.

A flat frame-shaped slider 48 is fit movably over the tongue main body 30 in the longitudinal direction. The slider 48 has a second slit 50 and a second wall 52. The second wall 52 is formed to the rear edge of the slider 48 on one side of the plate surfaces of the tongue main body 30 and opposes to the first wall 42.

The second slit 50 is extended in the other of the plate surfaces (lower surface in FIGS. 1, 2) of the tongue main body 30 in the lateral direction crossing the longitudinal direction of the tongue main body 30. The rear edge 50A of the second slit 50 situates ahead of the first wall 42 (rightward in FIGS. 1, 2) also in a state where the second wall 52 overlaps with the first wall 42 by way of the belt 10.

Further, the third slit 44 is disposed so as to situate behind the rear edge of the slider 48 also in a state where the slider 48 is retracted to the retracting limit so as to put the belt 10 between the first wall 42 and the second wall 52.

In the tongue assembly having thus been constituted, the shoulder belt 10B of the belt 10 reaches the first slit 40 while passing between the first wall 42 and the second wall 52 and further passes through the first slit 40 and passes through the second slit 50. Further, the belt 10B is turned back at the rear edge of the 50A of the second slit 50 and reaches the third slit 44 and then passes through the third slit 44 and reaches the belt top end. A belt situated on the side of the top end from the turned back portion at the tongue main body 30 constitutes a lap belt 10A.

When tension is applied to the belt 10, the belt 10 resiliently biases the slider 48 to the backward of the tongue as shown by arrow A in FIG. 1, in which the belt is strongly held between the second wall 52 and the first wall 42.

As apparent from FIG. 1, in this embodiment, the lap belt 10A turned back at the rear edge 50A of the second slit 50 is extended straight forward along the slider 48 behind the tongue. Accordingly, the tension applied to the belt 10 strongly attracts the slider 48 to the backward of the tongue, and the belt is firmly held between the first and the second walls 42 and 52. In addition, since the belt 10 is strongly held between the first wall 42 and the second wall 52, if the shoulder belt 10B slackens, the tension is maintained as it is on the side of the lap belt 10A from the walls 42, 52, and the slider 48 maintains a strongly biased state in the direction of an arrow A. Accordingly, even if the shoulder belt 10B slackens, a large tension remains in the lap belt 10A, thereby making it possible to firmly hold the child seat on the vehicle seat continuously by the lap belt 10A.

Figure 3:
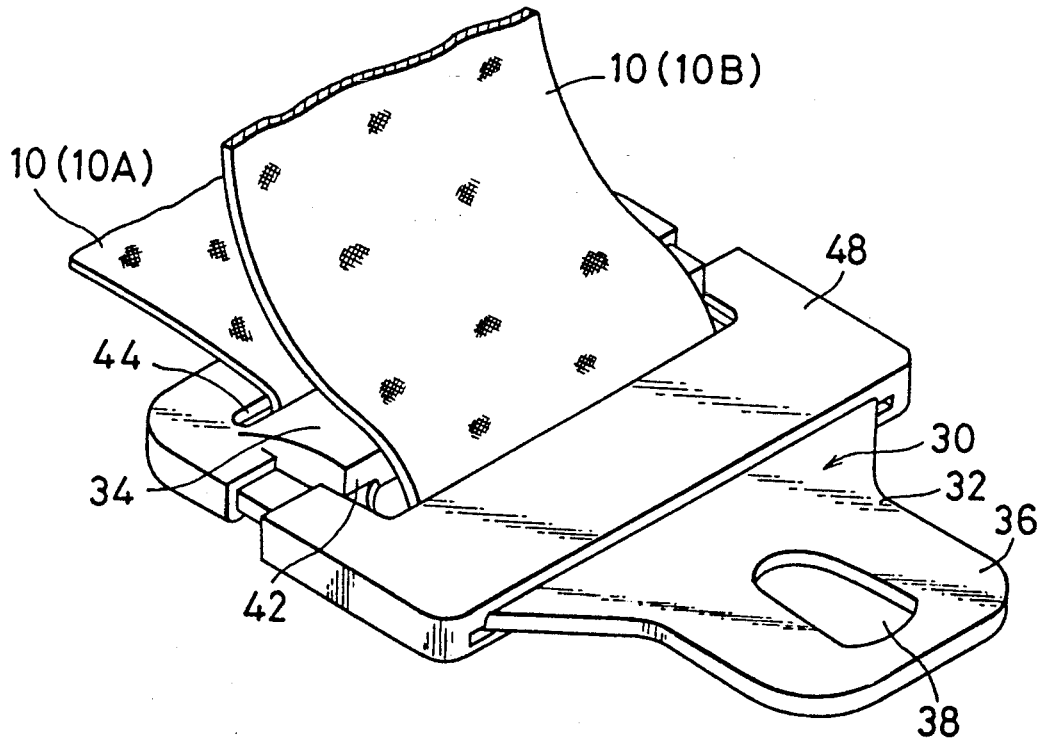
FIG. 3 is a perspective view of a tongue assembly in a state in which the belt is passed.
Figure 4:
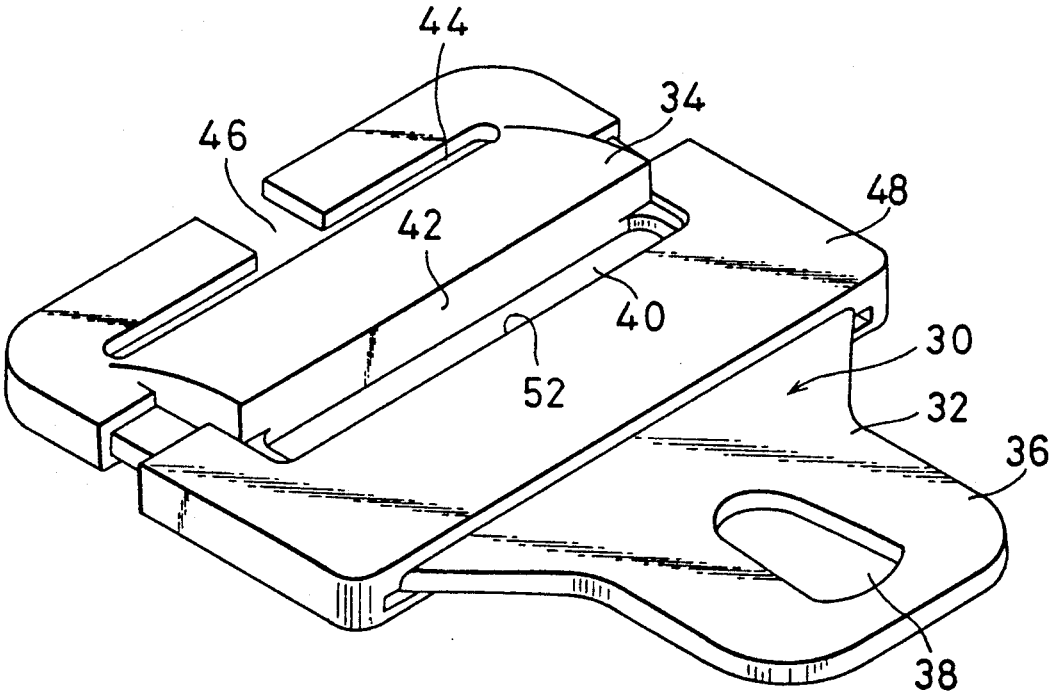
FIG. 4 is a perspective view of a tongue assembly in which the belt is removed.
Figure 5:
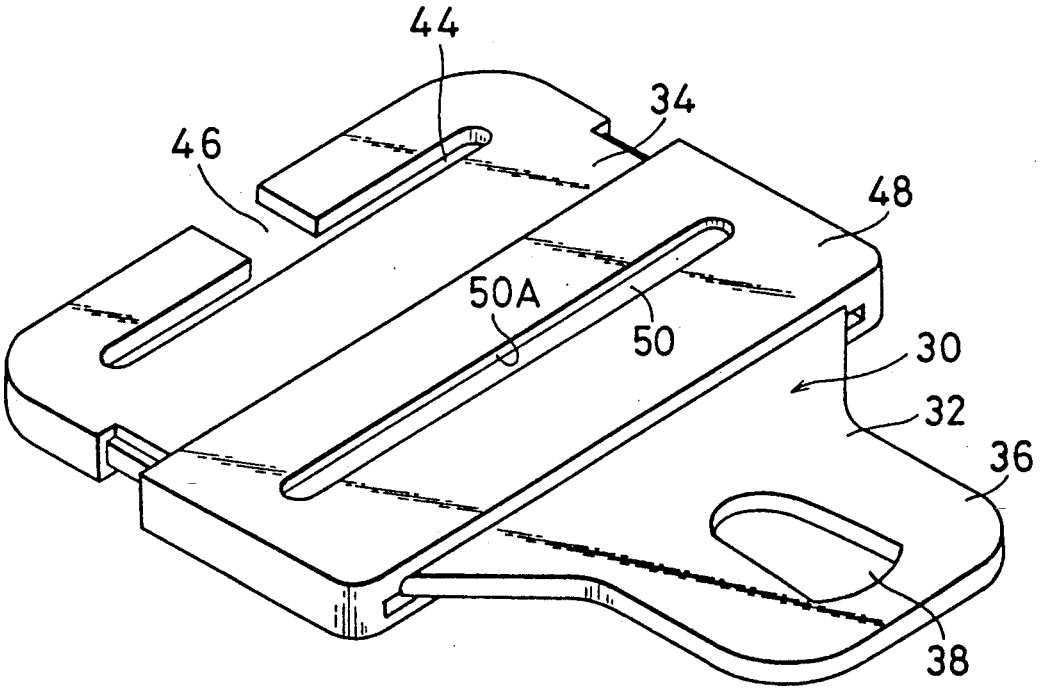
FIG. 5 is a perspective view for the bottom of the tongue assembly in a state where the belt is removed.
Figure 6:
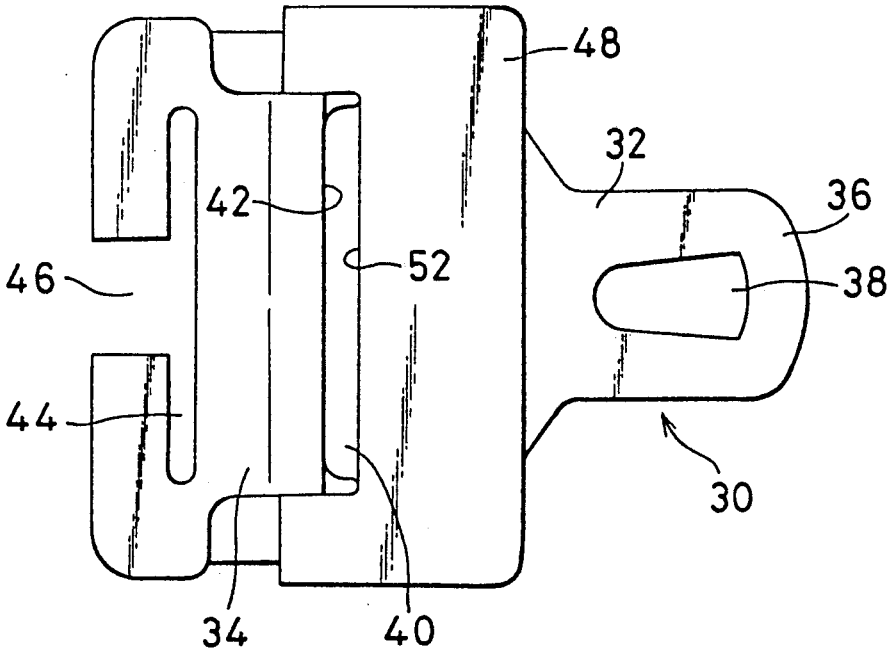
FIG. 6 is a plan view of a tongue assembly.
Figure 7:
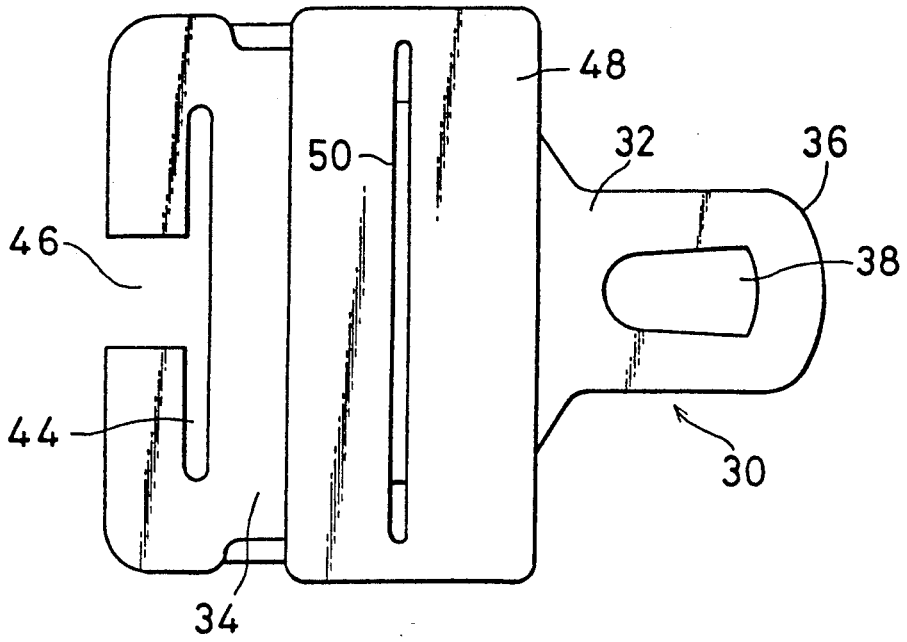
FIG. 7 is a bottom view of a tongue assembly.
Figure 8:
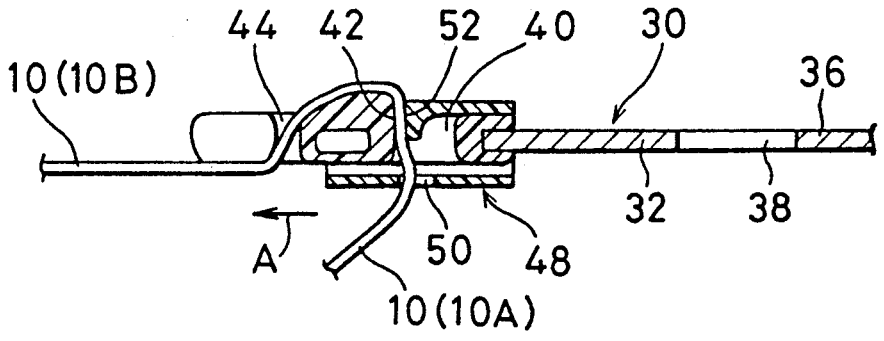
FIG. 8 is a cross sectional view of a tongue assembly in a case where the way of passing the belt is made different.
Figure 11:
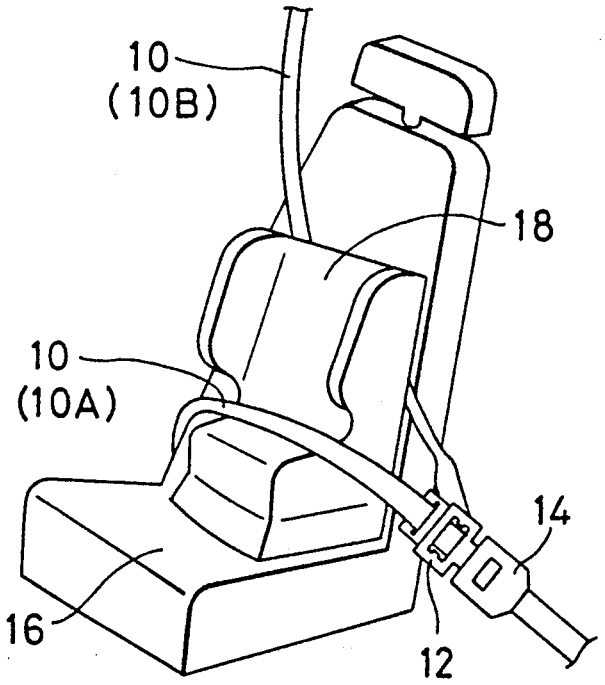
FIG.11 PRIOR ART
FIG. 11 is a perspective view illustrating a fixing structure for a child seat.
Figure 9:
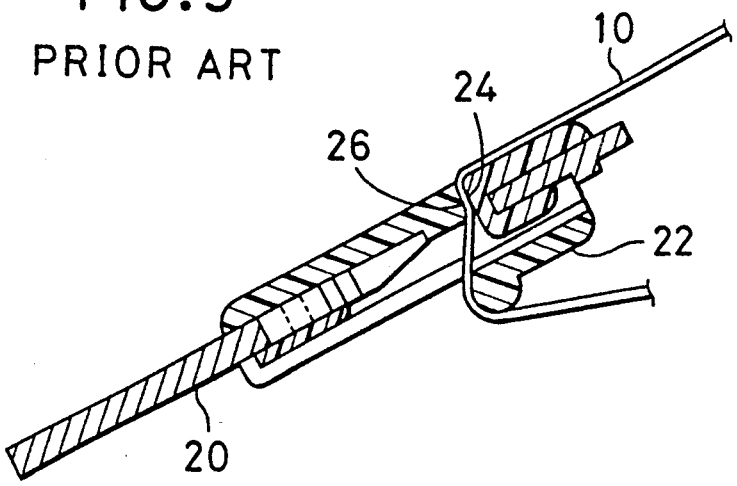
FIG. 9 PRIOR ART
FIG. 9 is a cross sectional view of an existent tongue assembly.
Figure 10:
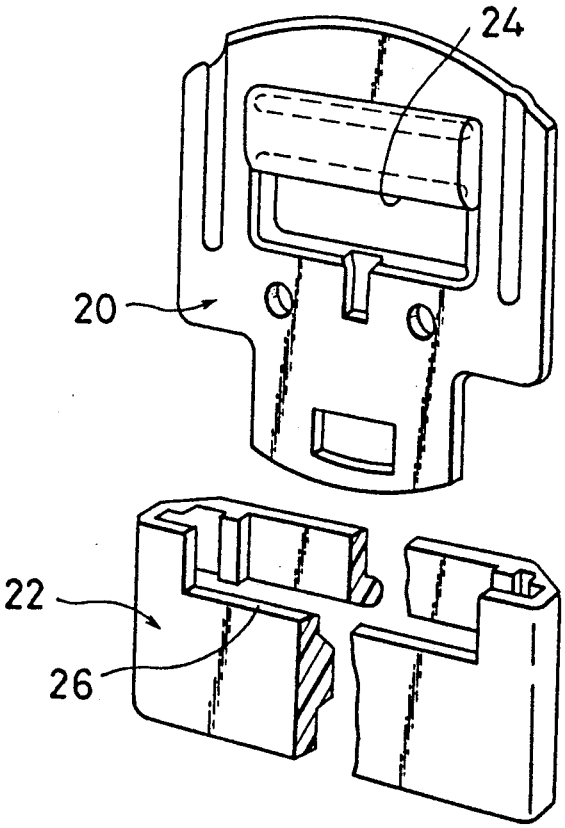
FIG. 10 PRIOR ART
FIG. 10 is an exploded perspective view of the existent tongue assembly.

In the tongue assembly according to the present invention, the belt 10 is inserted and passed through as shown in FIGS. 1 and 3. On the contrary, if the belt is inserted and passed through as shown in FIG. 8, no sufficient tension remains in the lap belt 10A, failing to hold the child seat firmly to the vehicle seat.

The reason is though such that the lap belt 10A, after passing through the rear edge 50A of the second slit 50, does not extend backwardly as it is and, accordingly, the component of the force applied to the slider 48 in the direction of the arrow A is reduced, thereby decreasing the seizing force for the belt 10 between the first wall 42 and the second wall 52.

As has been described above, with a tongue assembly for use in the seat belt device according to the present invention, the child seat of the vehicle seat can be held strongly and, even if the shoulder belt slackens in this case, the child seat can be continuously held firmly by the lap belt.

In the tongue assembly of the present invention, the belt can be inserted much easily to the third slit.

What is claimed is:

1. A tongue assembly for use in a seat belt device adapted to be attached to a seat belt and to engage a buckle, comprising:

a tongue main body having a rear portion, an insertion portion at a side opposite to the rear portion and adapted to engage the buckle, a middle portion between the rear portion and the insertion portion, and upper and lower surfaces, a first slit situated in the middle portion of the main body and extending in a direction perpendicular to an inserting direction of the main body relative to the buckle, a first wall portion fixed to the main body, said first wall portion projecting upwardly from the upper surface of the main body and extending along the first slit at a side of the rear portion, a slider slidably disposed over the middle portion of the main body and having upper and lower sides, a second wall portion formed in the upper side of the slider, said second wall portion extending parallel to the first slit at a side of the insertion portion and having a surface opposing to the first wall portion, a second slit formed at the lower side of the slider, said second slit extending parallel to the first slit and disposed under the second wall portion so that a rear edge of the second slit at a side of the rear portion of the main body is situated close to the insertion portion of the main body with respect to the surface of the second wall, and a third slit formed in the rear portion of the main body and extending parallel to the first slit, said seat belt extending between the first and second wall portions, through the first and second slits, under the lower side of the slider and through the third slit so that when a tension is applied from the side of the third slit, the slider is pulled toward the rear portion of the main body to urge the second wall portion of the slider to the first wall portion to thereby strongly hold the seat belt between the first and second wall portions.

2. A tongue assembly according to claim 1, wherein said tongue main body includes a recess at the third slit to communicate the third slit with an outside of the main body.

3. A tongue assembly according to claim 1, wherein said seat belt includes a lap belt and a shoulder belt, said shoulder belt extending from the first slit and the lap belt extending from the third slit.

4. A tongue assembly according to claim 3, wherein the second slit is positioned relative to the first wall portion such that when the lap belt is pulled, the rear edge of the second slit is moved toward the rear portion of the main body to firmly hold the seat belt between the first and second wall portions.

5. A tongue assembly according to claim 4, wherein the second wall portion extends downwardly from the slider and located inside the first slit.

6. A combination of a tongue assembly and a seat belt for use in a seat belt device adapted to engage a buckle, comprising:

said tongue assembly including:

a tongue main body having a rear portion, an insertion portion at a side opposite to the rear portion and adapted to engage the buckle, a middle portion between the rear portion and the insertion portion, and upper and lower surfaces, a first slit situated in the middle portion of the main body and extending in a direction perpendicular to an inserting direction of the main body relative to the buckle, a first wall portion fixed to the main body, said first wall portion projecting upwardly from the upper surface of the main body and extending along the first slit at a side of the rear portion, a slider slidably disposed over the middle portion of the main body and having upper and lower sides, a second wall portion formed in the upper side of the slider, said second wall portion extending parallel to the first slit at a side of the insertion portion and having a surface opposing to the first wall portion, a second slit formed at the lower side of the slider, said second slit extending parallel to the first slit and disposed under the second wall portion so that a rear edge of the second slit at a side of the rear portion of the main body is situated close to the insertion portion of the main body with respect to the surface of the second wall, and a third slit formed in the rear portion of the main body and extending parallel to the first slit, said seat belt extending between the first and second wall portions, through the first and second slits, under the lower side of the slider and through the third slit so that when a tension is applied from the side of the third slit, the slider is pulled toward the rear portion of the main body to urge the second wall portion of the slider to the first wall portion to thereby strongly hold the seat belt between the first and second wall portions.

7. A combination according to claim 6, wherein said seat belt includes a lap belt and a shoulder belt, said shoulder belt extending from the first slit and the lap belt extending from the third slit.

* * * * *

UNITED STATES PATENT AND TRADEMARK OFFICE

CERTIFICATE OF CORRECTION

PATENT NO. : 5,309,606

DATED : May 10, 1994

INVENTOR(S) : Yoshihisa Kawamura

It is certified that error appears in the above-identified patent and that said Letters Patent is hereby corrected as shown below:

Item [21],
On the Cover Page, Application Number, change "483,486" to --983,386--.

Signed and Sealed this

Ninth Day of August, 1994

*Attest:*

*Attesting Officer*

BRUCE LEHMAN

*Commissioner of Patents and Trademarks*